US005372027A

United States Patent [19]

Roper et al.

[11] Patent Number: 5,372,027

[45] Date of Patent: Dec. 13, 1994

[54] CONTROLLED MATERIAL FLOW HYDROFORMING

[75] Inventors: Ralph E. Roper, Indianapolis, Ind.; Gary A. Webb, West Bloomfield, Mich.

[73] Assignees: Armco Steel Company, L.P., Middletown, Ohio; Price Enterprises, Ltd., Madison Heights, Mich.

[21] Appl. No.: 919,968

[22] Filed: Jul. 27, 1992

Related U.S. Application Data

[63] Continuation-in-part of Ser. No. 855,815, Mar. 23, 1992, which is a continuation-in-part of Ser. No. 443,112, Nov. 29, 1989, Pat. No. 5,157,969.

[51] Int. Cl.[5] ..... B21D 26/02

[52] U.S. Cl. ..... 72/60; 72/350; 72/453.04; 29/421.1

[58] Field of Search ..... 72/56, 57, 60, 63, 296, 72/297, 350, 453.03, 453.04; 29/421.1

[56] References Cited

U.S. PATENT DOCUMENTS

| | | | |
|---|---|---|---|
| 4,576,030 | 3/1986 | Roper | 72/296 |
| 5,157,969 | 10/1992 | Roper | 72/60 |

FOREIGN PATENT DOCUMENTS

| | | | |
|---|---|---|---|
| 35026 | 11/1975 | Japan | 72/60 |
| 166127 | 8/1985 | Japan | 72/60 |
| 1021513 | 6/1983 | U.S.S.R. | 72/60 |

OTHER PUBLICATIONS

Roper, Ralph E. "Progressive Dies with Stretch Forming" (1986).

*Primary Examiner*—David Jones

*Attorney, Agent, or Firm*—Larry A. Fillnow; Robert J. Bunyard; Robert H. Johnson

[57] ABSTRACT

A sheet metal blank positioned upon a lower die is wrapped around an upper die as the upper die is moved down to a closed position by an outer slide, the blank being clamped between the upper and lower dies whereby the periphery of the blank is gripped between a male and female bead mounted all around a part print cavity in the upper and lower dies, respectively. The outer slide then dwells while an inner slide moves down, engaging and actuating cylinder assemblies, causing hydraulic fluid to be forced into a region between the clamped blank and the lower die, the blank being formed into a part print cavity defined in the upper die. The male bead exerts varying control on the sheet to allow it to stretch across portions of the cavity while flowing into other portions of the cavity. A locking mechanism prevents the bending of the dies and holds the dies in a closed position thereby assisting the engagement of the male bead with the female bead. As a safety feature, the mechanism is configured to automatically open when the die cavity is moved up. The locking mechanism allows the use of high pressures to make large parts, such as car hoods, doors, deck lids, and quarter panels in conventional currently available double action presses.

5 Claims, 12 Drawing Sheets

CONTROLLED MATERIAL FLOW HYDROFORMING

REFERENCE TO RELATED APPLICATION

This application is a continuation-in-part of U.S. patent application Ser. No. 07/855,815, filed Mar. 23, 1992 entitled "Apparatus and Method for Hydroforming Sheet Metal" by Ralph E. Roper which is a continuation-in-part of Ser. No. 07/443,112 filed Nov. 29, 1989, now U.S. Pat. No. 5,157,969 all of which are herein incorporated by reference.

FIELD OF THE INVENTION

The present invention relates to the field of sheet metal forming, and in particular, to an apparatus and method for hydroforming sheet metal into parts such as automobile fenders, doors, hoods and the like.

BACKGROUND OF THE INVENTION

In the high-production cookware, appliance and automotive industries, as well as the low- and medium-production aircraft, aerospace, and job-shop industries, metallic sheet may be formed by a variety of different dies, the type and size of the die being dictated by the shape and intended use of the particular part. One process which is used to form a wide variety of these parts is the conventional drawing process. In a draw die, the blank is drawn across a binder surface allowing metal to flow from the bind surface and onto the part. Unfortunately, variable and non-uniform stresses are thereby developed throughout the part which results in localized stretching. This creates severe springback and shape retention problems which make it nearly impossible to predict, especially with large parts, the amount of springback that will occur. The common practice to overcome this springback or shape retention problem overbend (deform beyond the desired shape) the part. Finding the appropriate degree of overbend requires a number of costly trial and error procedures. There is also a significant amount of material waste in the drawing process because the blank is oversized to compensate for the metal flowing across the binder surface and into the die cavity.

In U.S. Pat. No. 4,576,030, a process is described wherein sheet metal can be one hundred percent stretch formed between co-acting male and female die halves. This is accomplished by providing a pair of opposed lock beads, at least one of which is provided with a number of spaced apart beads adapted to bite into the sheet metal, around the periphery thereof, when the gripper steels are closed. This permits the sheet metal to be homogeneously; one hundred percent stretch formed, thus resulting in a higher quality of shape retention, a reduction in the number of shock lines and stretch lines, less waste, and increased overall part strength.

Another procedure which enhances the quality of the formed part is fluid forming, that is, applying pressurized fluid against one side of the blank in the forming process. The benefits include increased versatility, a better finish on the final parts lower tool and reduced maintenance costs.

In U.S. patent application Ser. No. 07/855,815, entitled "Apparatus and Method for Hydroforming Sheet Metal," attorney docket no. (4397/21) incorporated herein by reference, a process for stretch forming sheet metal by applying pressurized fluid against one side of the blank is described. The blank is 100% stretch formed into the part print cavity of the upper die. The process for stretch forming described involves placing the sheet metal in preferably, a conventional double action press. The gripper beads fitted to the upper and lower binders of the die are configured to bite into the sheet metal around the periphery to hold the blank in place and to seal it along the periphery. The type of gripper beads that were found to be particularly useful in gripping and sealing the sheet metal blank were those disclosed in U.S. Pat. No. 4,576,030 described above. When the press is closed, the gripper beads are forced into the metal sealing its periphery. The liquid is then applied under pressure to the side of the sheet metal opposite from the die cavity configured for the part to be produced. The pressure of the liquid is sufficiently high to stretch form the sheet metal against the die cavity to produce the shaped part.

While these advancements have continued to improve the quality of the part and stretch the limits of product design, there are part configurations which cannot take advantage of 100% stretch forming. In particular, a part may have a configuration which, if the blank were 100% stretched, would cause thinning in areas where the elongation requirements of the configuration are above that of the blank material. In addition, tearing of the blank material may result.

It is desirable to provide specific tooling usable in a conventional double action press which combines the favorable aspects of fluid forming, the advantages of stretch forming and the flexibility of draw forming to permit a more accurate approximation of the desired part while reducing if not eliminating the problem of thinning or tearing of the blank material.

Another problem in using the process and apparatus of the prior art is that when large parts are being formed, enormous total hydraulic pressure is generated on the dies and transmitted to the press. For example, a car hood has generally about 2,000 square inches of area. If the desired forming pressure is 4,000 psi, then the resultant force on the dies is 2,000 square inches times 4,000 psi which equals 4,000 tons. Such force can deflect the die which spans across the outer blank holder opening sufficiently to cause the grippers to disengage. Even a slight deflection of the die can cause the gripper beads to disengage causing the hydraulic fluid to leak. To assure that the pressure of the liquid does not distort the shape of the die and cause leaks, high tonnage rated presses must be used. However, this significantly increases the cost of the operation. Additionally, conventional presses of sufficient tonnage may not be available for large parts that require high forming pressure.

It is desirable to provide a mechanism which locks the upper and lower dies securely together during the forming process. Such security allows lower tonnage presses to be used in the forming process.

SUMMARY OF THE INVENTION

The present invention is a self-contained, controlled material flow hydroforming die apparatus which is adapted to operate within a standard double action press and which is adapted to form a variety of different parts from metal sheet.

A standard double action press, including first and second vertically reciprocating slides, is provided with a basic die, which includes a riser mounted to the outer slide, a base in the form of a manifold, a fluid reservoir formed by a tub and hydraulic cylinder assemblies connected to the base. Each of the hydraulic cylinder assemblies includes an upwardly extending piston rod which is engaged and depressed by each downward stroke of the inner slide of the press. Specific tooling is provided for the particular part to be formed and includes mating upper and lower dies which are mounted in vertical alignment to the corresponding riser and manifold. The upper die defines a downwardly facing part print cavity. Sheet metal as a blank or coil fed, is positioned upon the lower die by blank locators. The sheet metal is preferably clamped between the upper and lower dies whereby the periphery of the blank is gripped between a male and female bead formed in the upper and lower dies respectively. The outer slide then dwells while the inner slide moves down, engaging and actuating upwardly extending rods of the cylinder assemblies, causing hydraulic fluid to be forced through passageways in the manifold and lower die and into a region between the clamped blank and the lower die. The pressurized liquid forces the blank against the part print of the upper die. The control exerted on the periphery of the blank by the male bead allows portions of the blank to be stretched while other portions are allowed to flow into the mold cavity defined in the upper die.

At the end of the forming operation, both inner and outer slides are raised, the piston rods of the cylinder assemblies being raised by gas springs, As the outer slide moves upward, lifting the upper die therewith, the pressurized fluid trapped between the formed part and the lower die spills out all around the lower die and into the tub which acts as a fluid reservoir, the reservoir being the sump for the hydraulic cylinder assemblies. The apparatus is thus self-contained and fluid recirculating.

When it is desired to form a different part with the apparatus of the present invention, the specific tooling, that is, the upper and/or lower dies, are replaced with specific tooling defining a desired pare print. The male bead defined in the upper die of the specific tooling exerts the necessary control to form the part defined by that specific tooling. The remainder of the apparatus remains in place and is intended to be used for many years with different specific tooling to form a variety of different sheet metal parts.

A locking mechanism is retrofitted to a standard double action press which includes a driver mounted on the inner slide, a locking arm which is pivoted from its locked position to its unlocked position and vice versa and a driver block mounted on the side of the riser which directs the driver as the inner slide is lowered. The locking arm has a lip which when the arm is in its locked position, overlies a portion of the top surface of the upper die to hold the upper die in its closed position during the forming process. A positive return is located on both the locking arm and the retainer brackets linking the upper die to the riser which forces the locking arm to its unlocked position when the forming process is finished.

It is an object of the present invention to provide an improved apparatus for forming sheet metal which combines the favorable aspects of fluid forming, stretch forming and draw forming to permit a more accurate approximation of the desired part.

It is another object of the present invention to provide the means for combining the favorable aspects of fluid, stretch and draw forming in the form of a male bead which has a changing profile along the periphery of the desired part print defined in the upper die of the specific tooling.

It is another object of the present invention to provide an apparatus for forming sheet metal which affords greater versatility in forming a variety of different parts where the cost and time for retooling are minimized.

It is a further object of the present invention to provide an apparatus for hydroforming sheet metal which is substantially self-contained.

Another object of the present invention is to provide a locking mechanism which makes hydroforming more efficient and which can be easily and inexpensively used with conventional presses.

A further object of the present invention is to provide a simple and inexpensive mechanism which allows for use of lower tonnage presses in hydroforming of metal parts by stretch forming of sheet metal.

Still another object of the present invention is to provide a locking mechanism which is safe to operate in that it automatically opens when the press is opened.

A still further object of the present invention is to provide a simple, efficient, inexpensive and safe mechanism which maintains the dies of the press closed during the forming operation.

Still another object of the present invention is to provide a locking mechanism which is located near the center of the unsupported sides of the die so as to prevent the die from deflecting when hydraulic pressure is applied to form the shaped part.

DETAILED DESCRIPTION OF THE PRESENTLY PREFERRED EMBODIMENTS

Figure 1:
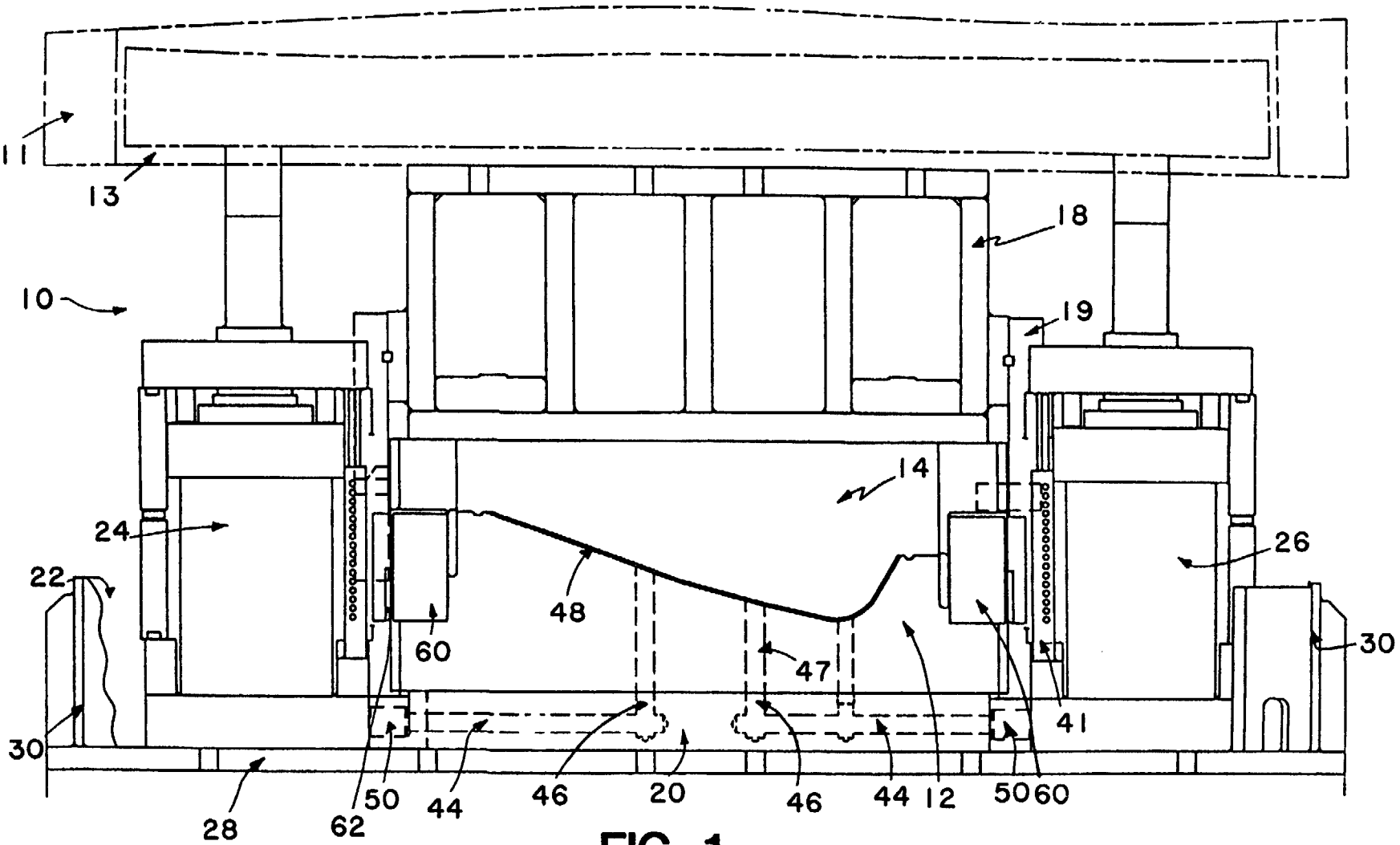
FIG. 1 is a front elevational view of apparatus 10 for hydroforming sheet metal in accordance with a first preferred embodiment of the present invention, and adapted for operation with a conventional double-action press.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 illustrates a front elevational view of an apparatus 10 for hydroforming sheet metal in accordance with a first preferred embodiment of the present invention. Apparatus 10 is adapted to operate in and with a conventional double action press. Such presses generally include an outer slide 11 (commonly called an outer blank holder) which has a rectangular tube shape and is mounted for vertical reciprocal movement. A similarly shaped inner slide 13 is likewise mounted for vertical reciprocal movement, telescopically within outer slide 11. Slides 11 and 13 are moved up and down independently by separate linkages thereabove (not shown) as is well known by those skilled in the art.

Apparatus 10 of the present embodiment comprises a "basic die" and "specific tooling". The basic die comprises a portion of the user's "capital equipment". That is, the basic die includes those elements of the apparatus which are intended to be used for a very long time to make a variety of different parts. The specific tooling, on the other hand, comprises the interchangeable attachments which actually form the part. The specific tooling is made up of components which are mounted within and operated by the basic die and are changed each time a different part is to be formed.

"Blank" as used herein refers to a portion of sheet metal which is positioned between the lower and upper dies 12 and 14 and is to be formed in accordance with the present invention. The blank may be a single piece of sheet metal (shown as 16 in FIG. 3) or it may be portion of coil of sheet metal (not shown) as in a progressive die.

Figure 3:
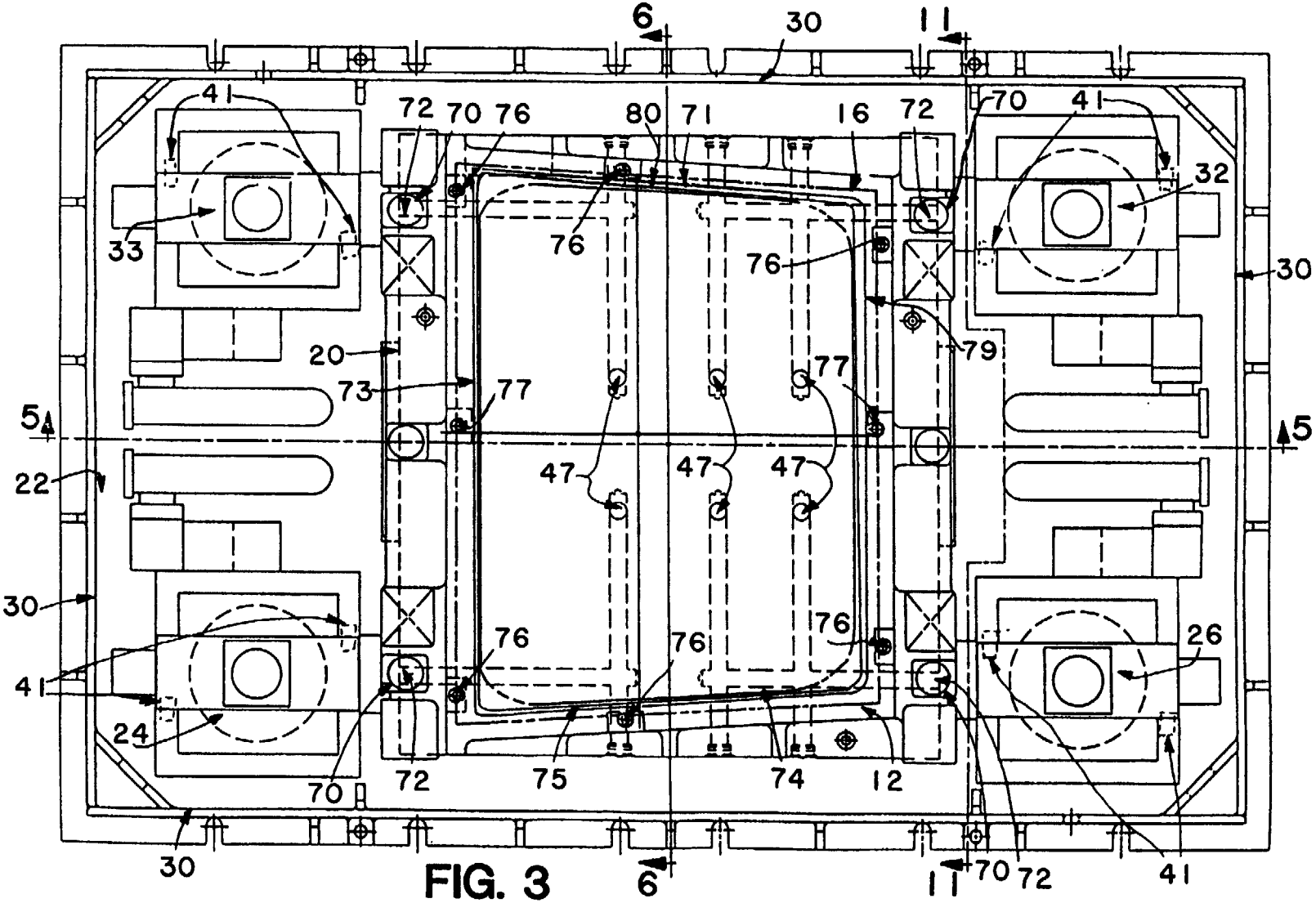
FIG. 3 is a plan view of the lower half of apparatus 10 of FIG. 1.

The basic die is secured to a standard double action press and generally includes a riser 18, a manifold 20 and preferably a four post hydraulic cylinder assembly (shown as 24, 26, 32 and 33, in FIG. 3). The riser 18 is fixedly mounted to the outer slide 11 to move as a unit therewith and is dimensioned to vertically reciprocate between the four post hydraulic cylinder assembly. The riser 18 is secured to the outer slide 11 by conventional means.

The double action press is placed in a tub 22 which is defined by a base plate 28 which extends outwardly and transitions into upstanding sidewalls 30. The tub 22 acts as a fluid reservoir or sump for the cylinder assembly as will be described in detail hereinafter. Secured to the base plate 28 of the tub 22 by conventional means is the manifold 20. The manifold 20 defines horizontal passageways 44 and connecting vertical manifold passageways 46 which allow fluid pumped by the cylinder assembly to communicate with the lower die 12 which will be described in detail hereinafter.

Secured to the manifold 20 is the lower die 12 of the specific tooling. Defined in the lower die 12 are vertical lower die passageways 47 which open to the upwardly facing surface 48 of the lower die 12. The lower die 12 is horizontally aligned on the manifold 20 by appropriate cross-keys (now shown) so that the vertical passageways 46 in the manifold 20 are aligned with the vertical lower die passageways 47 of the lower die 12.

Figure 11:
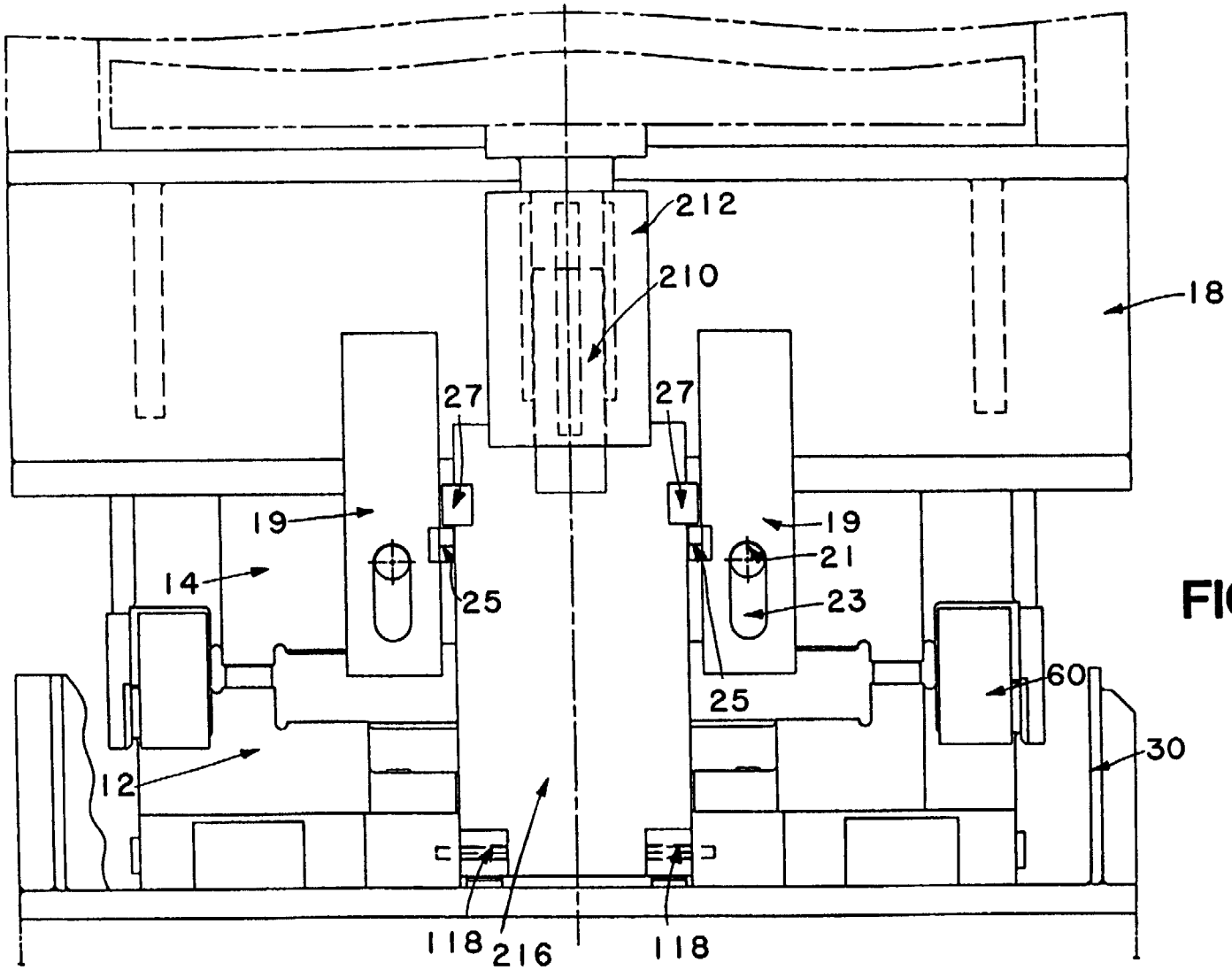
FIG. 11 is a side view of a portion of the locking mechanism taken along line 11—11 of FIG. 5.

The upper die 14 of the specific tooling is secured to the riser 18 in a "floating" arrangement. More specifically, the die 14 is separated from the riser 18 approximately 5 inches (not shown in FIG. 1) when the upper die 14 is not in contact with the lower die 12. With reference to FIG. 11, two retainer brackets 19 are located on each side of the riser 18 and two retainer pins 21 are located on each side of the upper die 14. The retainer pins 21 and brackets 19 link the die 14 and riser 18 together. More specifically, a slot 23 in the bracket 19 allows retainer pin 21 to slide therein. When the upper die 14 is not in contact with the lower die 12, the upper die 14 is at its greatest separation from the riser 18. As the die 14 makes contact with the lower die 12, pin 21 slides in a vertically upward direction along the slot 23 in the bracket 19 thereby reducing the separation between the upper die 14 and the riser 18. When the outer slide 11 has descended to its final position as shown in FIGS. 1 and 11, the pin 21 will have reached the top of the slot 23 in the bracket 19 and the upper die 14 will be in contact with the riser 18.

A pair of heel blocks 60 (FIGS. 1 and 6) are secured at each corner of the upper die 14 to aid and assure perfect alignment upon closing of die 14 upon die 12. Each heel block 60 is provided with a bronze wear plate 62 at its lowers interiorly facing portions, the wear plates coming in contact with and heeling along the outer side surface of the lower die 12. Dies 12 and 14 are thereby assured to be in perfect horizontal alignment each time outer slide 11 and upper riser 18 ram down, bringing upper die 14 down upon lower die 12.

Figure 2:
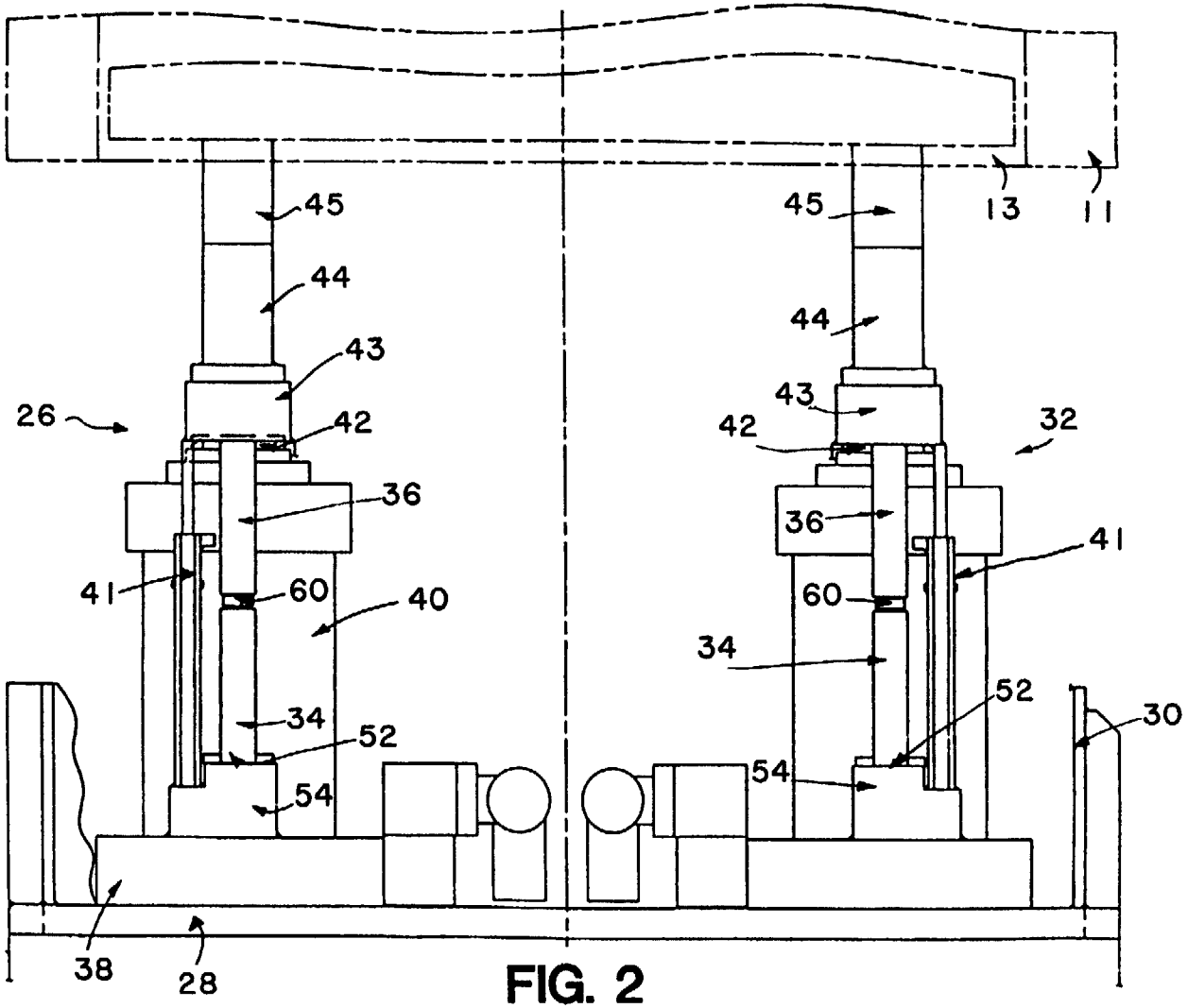
FIG. 2 is a side elevational view of the apparatus 10 shown in FIG. 1 with the riser, upper die and lower die removed to illustrate two of the hydraulic cylinders forming the four post hydraulic cylinder assembly.

FIG. 2 is a side elevational view of the apparatus 10 shown in FIG. 1 with the riser, upper and lower dies removed. FIG. 2 illustrates two of the hydraulic cylinder units 26 and 32 which form part of the four post cylinder assembly, according to the present invention. There are two identical cylinder units located on the other side of the apparatus (shown in FIG. 3 as 24 and 33). The four hydraulic cylinder units are identical and the following description of cylinder 26 will apply equally to the remaining three cylinder units. Cylinder unit 26 includes a lower head 38, a cylinder 40, and a piston rod 42. The cylinder units are mounted atop bed 28 of the tub 22 by conventional means such as bolts or screws as is well known to those skilled in the art. Piston rod 42 is connected to the bottom of inner slide 13 through various steels and is adapted to cooperate with the movement of inner slide 13. Preferably piston rod 42 is mounted in a collar 43 by conventional means. A separate block 44 is welded to a plate, which is then fastened to collar 43 by conventional means to extend the reach of the piston 42. Another separate block 45 may be provided on top of block 44 to adjust for stroke and press differences. Block 45 and thus piston rod 42 and the bottom of inner slide 13 are rigidly, mutually connected to move as a unit by appropriate means such as screws (not shown) extending through the bottom of block 45 into the face of inner slide 13. Each cylinder unit is preferably adapted for a 18-inch stroke, 15–66 gallon capacity, although these parameters will vary with the size and capacity of the overall apparatus 10.

Mounted on each side of each cylinder unit is a pair of vertically stacked gas springs 34 and 36 of which only one half of the pair is shown in FIG. 2. The two gas springs 34 and 36 are mounted opposing each other. Lower spring 34 is appropriately fixed at its base 52 to the base 38 of the cylinder via a base block 54 by conventional means such as set screws for tightly securing spring 34 thereto. A coupler 60 is mounted to the piston rod (not shown) of the lower spring 34. The piston rod (not shown) of the upper spring 36 rests in a pocket (not shown) in coupler 60. The base of spring 36 is mounted by conventional means to collar 43 which is connected to piston rod 42.

A check flow valve (not shown) is mounted inside of a block 50 (shown in FIG. 1) that connects the cylinder units to the manifold 20 and provides fluid communication between the horizontal passageways 44 in the manifold 20 and the cylinder units.

Alternatively, a "two post" hydraulic cylinder assembly may be used as described in U.S. Ser. No. 07/855,815, described above and incorporated herein by reference. The four post cylinder assembly is preferable, however, because it delivers a greater amount of fluid at higher pressure which allows complex parts to be formed using the hydraulic pressure delivered by the assembly. A filter assembly, fluid return and valve assembly are provided as appropriate within and in connection with lower head 38 of the cylinder assembly as described with reference to the two post cylinder assembly application above and thus need not be described in detail.

Figure 10:
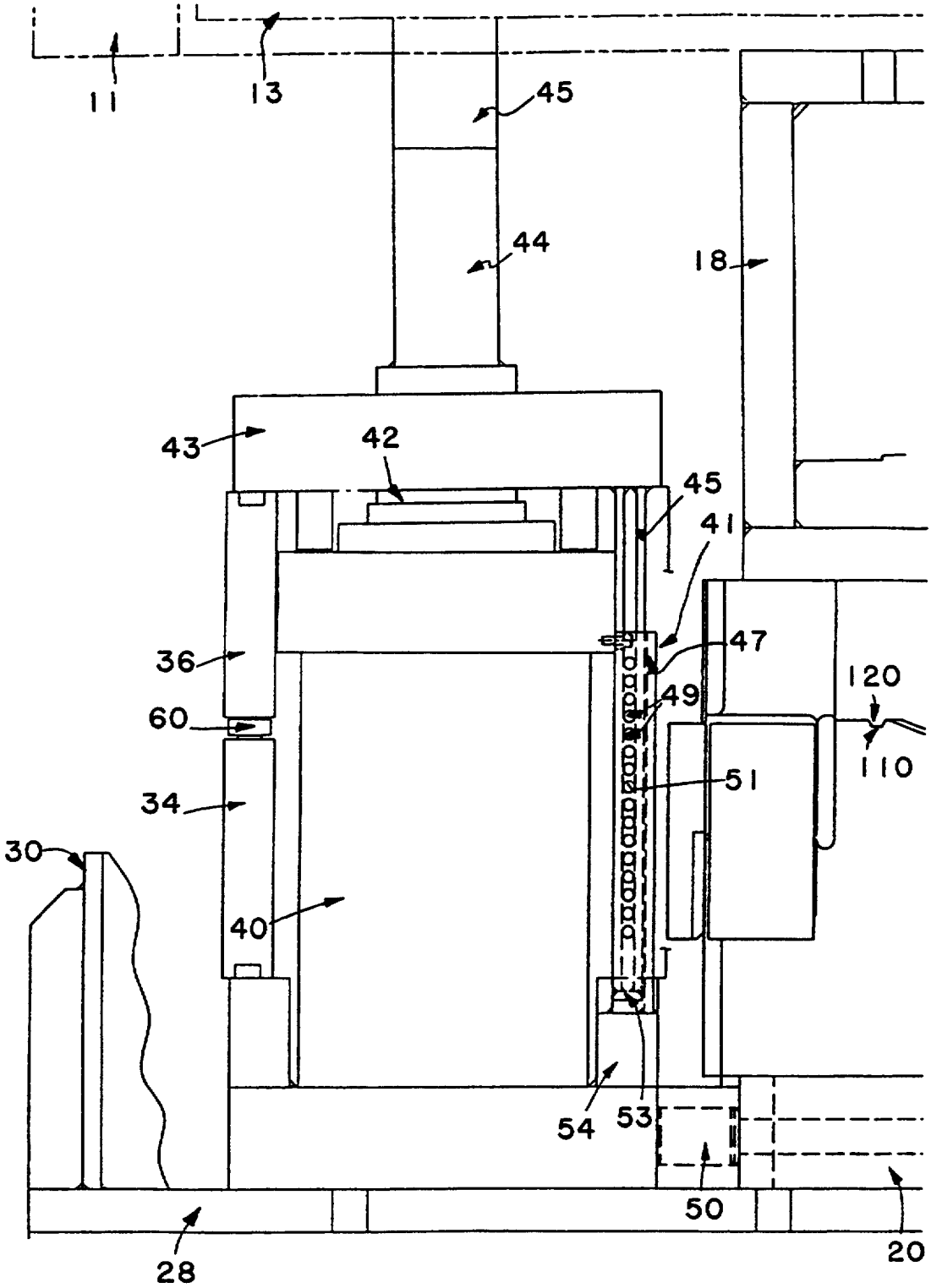
FIG. 10 is an elevational view of a hydraulic cylinder unit retrofitted with an antirotational and stroke adjustment assembly according to a second preferred embodiment of the present invention.

Because of the pressures exerted on each cylinder unit by the inner slide 13, there is a tendency for the piston rod 42 and blocks 44 and 45 of the cylinder unit to twist as they are lowered which causes the vertically stacked gas springs 34 and 36 to also twist as the piston rod 42 descends. To counter the twisting effect, a stroke adjustment and antirotation assembly 41 is mounted on both sides of each cylinder unit (see FIG. 3). Shown in detail in FIG. 10, the assembly 41 comprises an inner sliding member 45 and a stationary member 47. The stationary member 47 is mounted to the base block 54 of the cylinder unit and the side of the cylinder 40. The inner sliding member 45 is mounted at one end to collar 43. The stationary member 47 is designed to receive therein the inner member 45. The inner member 45 is free to slide within the stationary member 47 and slides as the collar 43 and thus rod 42 are either raised or lowered. To control the extension of the piston rod 42, and thus the stroke delivered by the cylinder unit, holes 49 have been drilled along the stationary member 47 to receive therein a pin 51. The pin 51 can be placed in any hole 49 along the stationary member 47. The inner member 45 is open all along its center as shown and ends in a horizontal base 53. The placement of the pin 51 in a particular hole 49 along the stationary member 47 prevents the base 53 of the inner member 45 from moving vertically past that hole. The stroke of the cylinder unit can thus be controlled and varied by the placement of the pin 51. In addition, as the piston rod 42 and blocks 44 and 45 are lowered, the assembly 41 prevents the collar 43 and thus the piston rod 42 and blocks 44 and 45 from twisting.

FIG. 3 is a plan view of the lower half of apparatus 10 of FIG. 1 illustrating the tub 22, the four post cylinder assembly comprising cylinder units 24, 26, 32 and 33 and the lower die 12. As described earlier, apparatus 10 is housed in tub 22 surrounded by walls 30. At each corner of the tub 22 is a cylinder unit. In substantially the center of the tub 22 is the lower die 12 mounted on the manifold 20 (shown in dashed line). At each corner of the lower die 12 is a recess 70 with a stop block 72 positioned therein. Each stop block 72 is sized and mounted so as to prevent the upper die 14 and lower die 12 from making contact by an amount approximately equal to one-half the metal thickness of the blank to be formed. Thus, when the upper die 14 is rammed down with a blank positioned between the dies 12 and 14, stop blocks 72 will not contact the corresponding, downwardly facing surface of upper die 14. But, if die 14 is rammed down and there is no blank positioned between the dies 12 and 14, the downwardly facing surface of upper die 14 will contact stop blocks 72 thereby precluding dies 12 and 14 from contacting.

As described earlier, the passageways defined in the lower die 12 and manifold 20 open to the upper surface of the lower die 12 at various points 47 on the upper surface of the lower die 12. While only six openings 47 are illustrated in FIG. 3, there may be more or less needed depending upon the size and complexity of the desired part print.

The desired part print is defined in the upper die 14. The periphery of the part print defined by die 14 is shown in FIG. 3 as line 74. The blank 16 is shown positioned on the lower die 12 surrounded by locators 76 and lifters 77. The locators 76 and lifters 77 are positioned outside the periphery 74 defining the part print. Located between the locators and periphery 74 generally indicated by the trapezoidal area 80 are gripping beads in the form of a male bead on the upper die and a female bead on the lower die which will be described in detail with reference to FIGS. 7–9. The beads run along all four sides of periphery 74.

Figure 4:
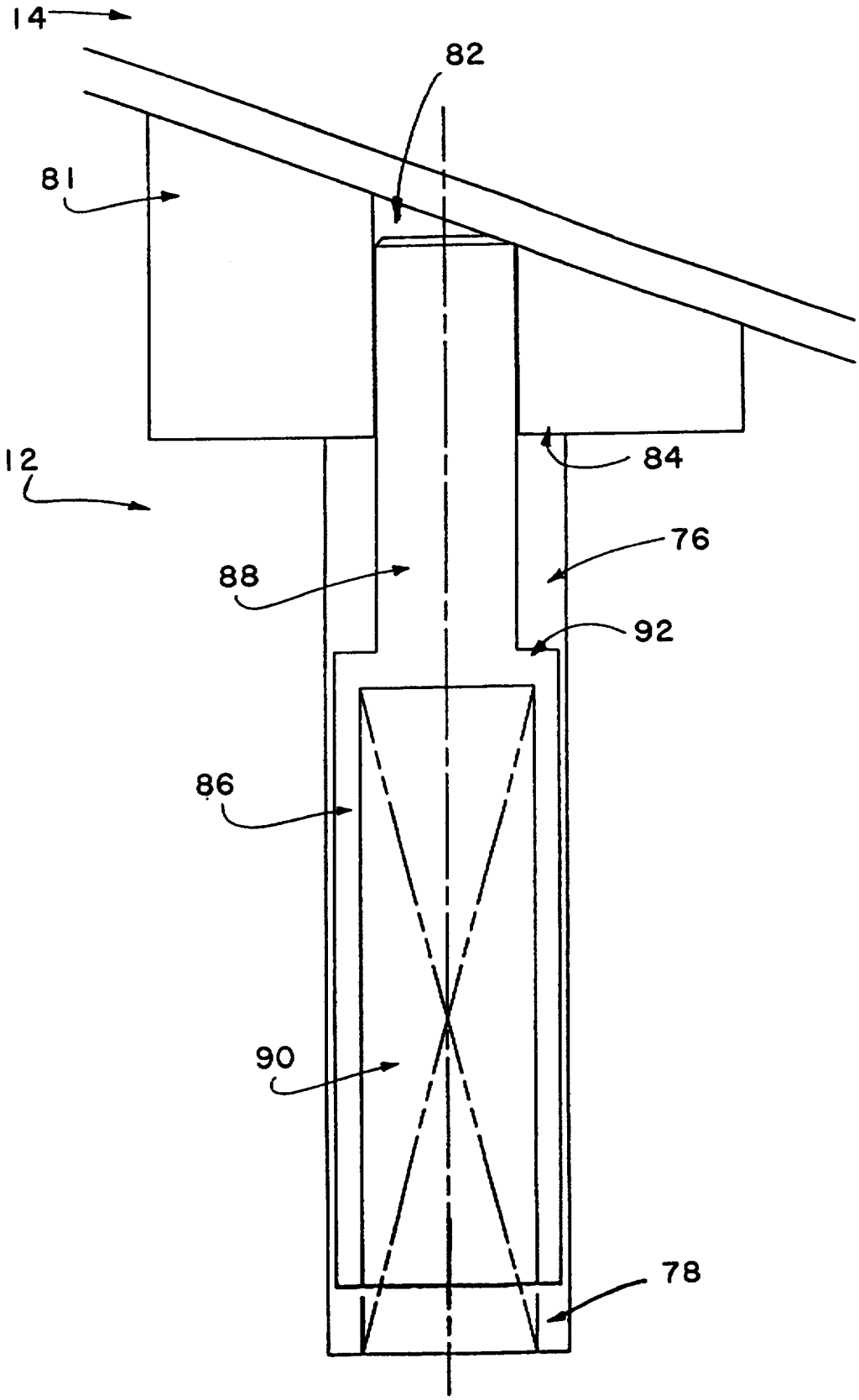
FIG. 4 is a cross-sectional view of a lifter according to the present invention.

FIG. 4 illustrates a cross-section of a lifter 77 with the upper die 14 lowered upon the lower die 12. Lower die 12 has defined therein a vertically extending bore 78. Bore 78 has a circular cross-section. A stopper 81 is placed on top of the bore 78. The stopper 81 has a bore 82 defined therein which has a circular cross-section having a diameter less than that of bore 78. The stopper 81 creates a ledge 84 extending into the bore 78. The lifter 77 is positioned in the bore 78. Lifter 77 is formed by two sections 86 and 88. Section 88 is a circular cross-sectioned rod having a diameter which is slightly less than the diameter of the bore 82 formed in the stopper 81. Section 86 is cylindrical with a cavity 90 defined therein. The outer diameter of section 86 is slightly less than the diameter of the bore 78. A shelf 92 is formed where the rod 88 meets the cylinder section 86. The dimension of the cavity 90 allows a coil spring 94 (shown in phantom) to fit within the cavity 90.

To place the lifter 77 in the lower die 12, the bore 78 is first drilled. Then a portion of the die 12 is removed which will later be replaced by stopper 12 The coil spring 94 is then dropped into the bore 78 of the lower die 12. The lifter 77 is inserted so that the coil spring 94 fits inside the cavity 90. The spring 94 will naturally be in its elongated state. The lifter 77 is then pushed down thereby compressing the spring 94 and the stopper 81 is positioned over the bore 78. When the pressure is removed from the lifter 77 the coil spring 94 will naturally want to go back to its elongated state but lifter 77 is prevented from exiting the bore 78 by stopper 81. As the spring 94 attempts to return to its elongated state, the lifter 77 will travel towards the surface of the lower die 12. The ledge 92 will hit the stopper 81 and prevent the lifter 77 from traveling further. The rod 88 of the lifter 77 will extend approximately 0.50 inches above the surface of the lower die 12. When the upper die 14 is lowered onto the lower die 12, the flat surface of the die 14 will press the lifter 77 into the bore 78 as seen in FIG. 4. The locators 76 seen in FIG. 3 are the same as the lifter 77 shown in FIG. 4 except that the rod 88 of the locators 76 extends approximately 1.25 inches above the surface of the lower die 12. As seen in FIG. 3, one lifter 77 is located at the front and back of the lower die 12. The locators 76 are located along the sides of the lower die 12 and on each side of a lifter 77. The function of the locators 76 and the lifters 77 will be described in more detail with reference to the operation of the apparatus 10.

Figure 5:
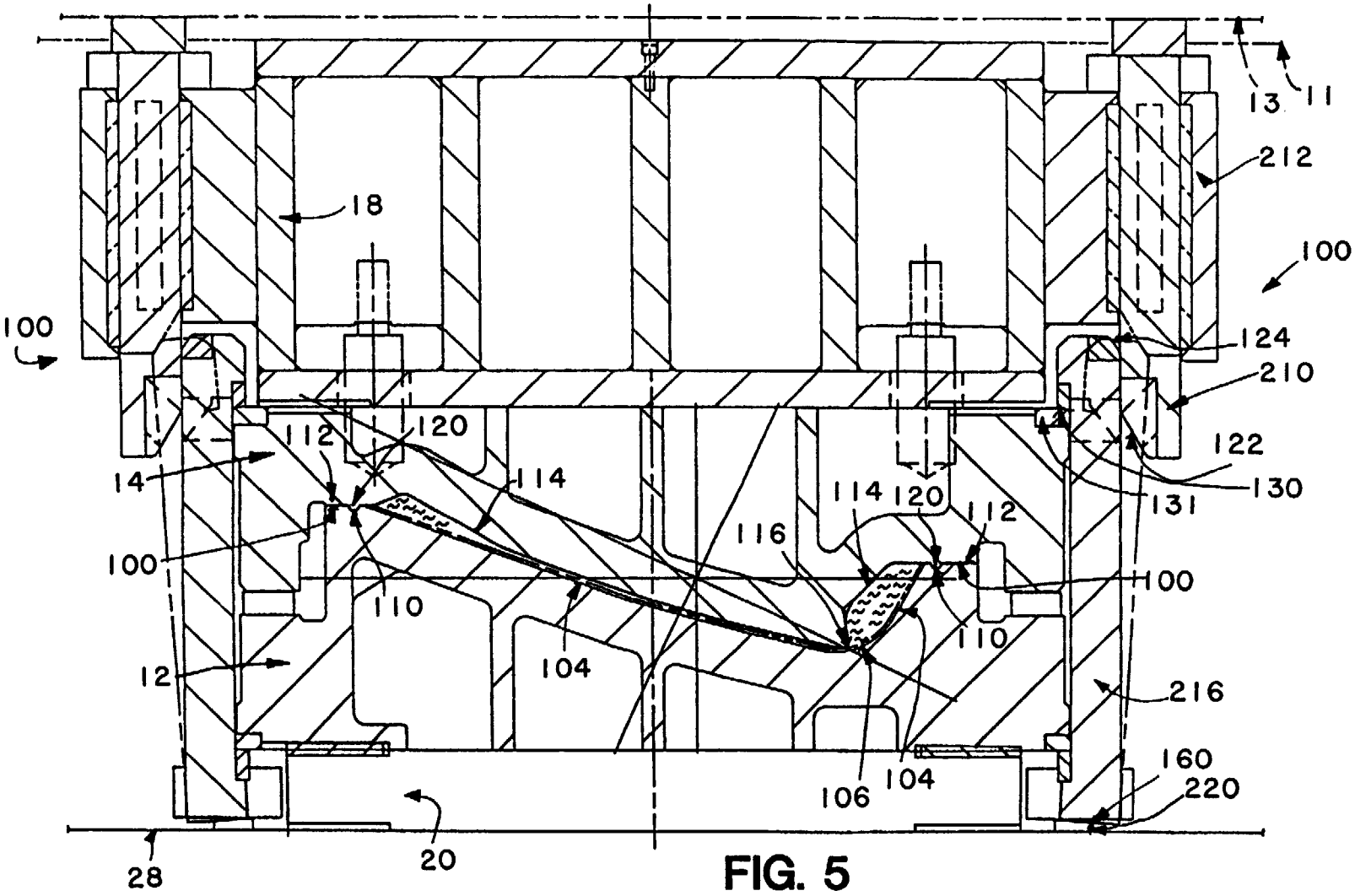
FIG. 5 is a cross-sectional view of the upper die lowered onto the lower die taken along the line 5—5 of FIG. 3.

FIG. 5 illustrates a cross-sectional view of the upper die 14 lowered upon the lower die 12 along line 5—5 of FIG. 3. The surface of the lower die 12 includes outer, horizontally planar surfaces 100 on the outsides of centrally declining planar surfaces 104 which are joined at valley 106. Formed in the horizontally planar surfaces 100 of the lower die 12 is a female bead 110. The female bead 110 is located just outside of the periphery 74 defining the part print as can be seen in FIG. 3 in the shape of a trapezoid 80.

The upper die 14 has a downwardly-facing die surface. The surface of the upper die 14 includes outer, horizontally planar surfaces 112 on the outsides of centrally declining planar surfaces 114 which are joined at curve 116. Formed into the horizontally planar surfaces 112 of the upper die 14 is a male bead 120. Like the female bead 110, the male bead 120 runs just outside the periphery 74 of the part print. The male bead 120 is vertically aligned with the female bead 110 so that when the upper die 14 is lowered, the male bead 120 fits inside the cavity formed by the female bead 110. The male and female beads will be described in detail with reference to FIGS. 7–9.

The surface of the upper die 14 located within the periphery of the male bead 120 defines the desired part print. The desired part print as illustrated in FIG. 5 has a complex shape. The curve 116 has a tight radius around which the blank must be wrapped and to the right of point 116 as shown in FIG. 5 is a deep cavity into which the blank must travel. While a particular part print has been illustrated in the Figures, the present invention is not limited to any particular part print. The present invention is directed to controlled hydroforming which can be used to produce a multitude of shapes. A locking mechanism 100 is also provided on each side of apparatus 10 shown in FIG. 5 which will be described in detail hereinafter.

Figure 6:
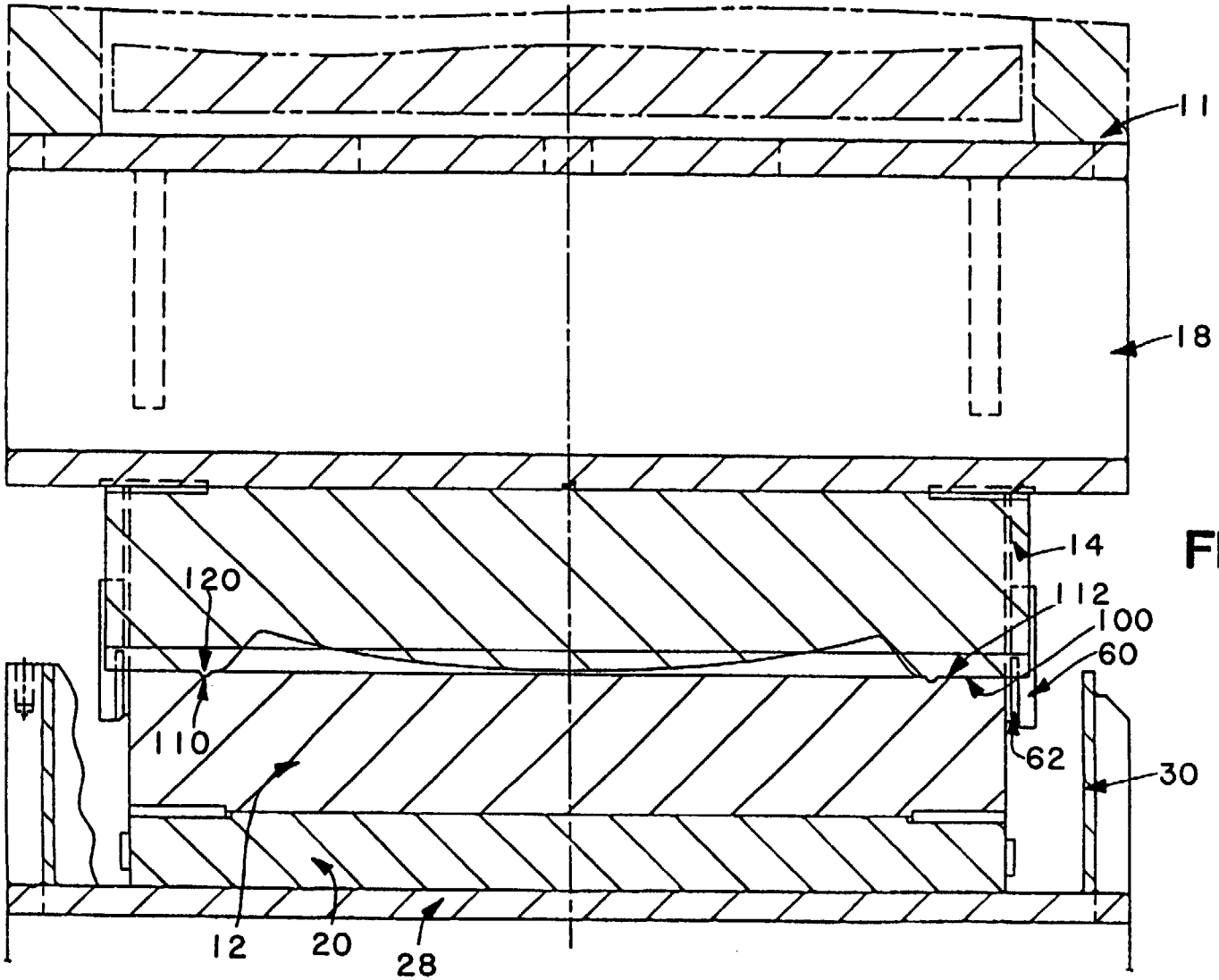
FIG. 6 is a cross-sectional view of the upper die lowered onto the lower die taken along line 6—6 of FIG. 3.

FIG. 6 illustrates a cross-sectional view of the upper die 14 lowered upon the lower die 12 along line 6—6 of FIG. 3. The surface of the lower die 12 located inside the periphery defined by female bead 110 is substantially constant. The surface of the upper die 14 located inside the periphery defined by the male bead 120 defines a central depression.

Figure 7:
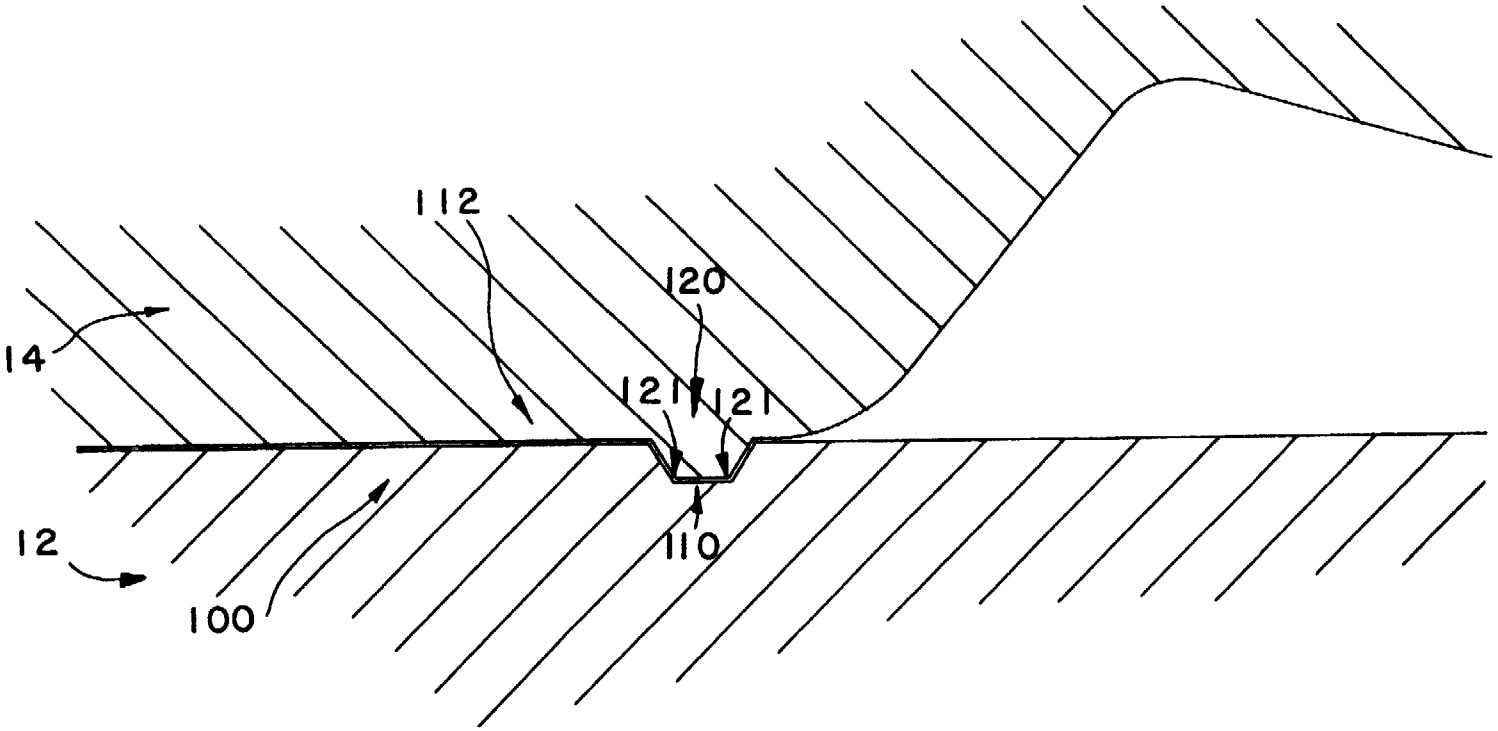
FIG. 7 is a cross-sectional view of the male bead engaged with the female bead when the upper die is lowered upon the lower die.

FIGS. 7 illustrates a portion of the upper die 14 lowered onto the lower die 12. In particular, the male bead 120 is shown engaged in the cavity formed by the female bead 110. As described previously with reference to FIG. 3, the male bead 120 runs along the periphery 74 in the shape of a trapezoid 80. Inside the periphery 74 is the desired part print defined in the upper die 14. The male bead 120 controls the hydroforming of the blank 16 into the desired formed part. This control is achieved by varying the shape of the male bead 120 along the periphery 74. The variation of the male bead 120 is dependent upon the desired part print and properties of the blank material. In FIG. 7, the male bead 120 is shown as having a generally rectangular cross-section. The control exerted by the male bead 120 is determined by the shape of corners 121 of the bead 120. When the corners 121 are sharp, as shown in FIG. 7, the bead 120 bites into the blank 16 and prevents the blank 16 at that location from slipping. If the corners 121 are rounded, as will be described with reference to FIG. 9, the blank 16 at that location is able to flow past the bead 120. The amount of flow depends upon the radius of curvature of the corners 121 of the bead 120.

In order to understand the necessity of having such control, the desired part print must be considered. With reference to FIG. 5, the desired part print has a point 116 with a small radius of curvature around which the blank 16 is to be wrapped. In addition, to the right of point 116 is a deep cavity into which the blank 16 must travel. As is well known by those skilled in the art, there are limitations dependent upon the material properties of the blank 16 which determine what amount the blank can be stretched before failure, such as tearing, occurs. Some parts therefore can not be made by 100% stretch forming because of the complexity of the desired part print and the properties of the blank used. Thus it must be determined where the blank can be stretched and where it must be allowed to flow. It has been found that in order to make this determination, several factors must be considered. One factor is the original starting length of the blank which is to be pressed against the desired part print. The second factor is the final length to which the original length of blank must be extended. The final length is the length of the desired part print between the same two points used to measure the original length. A third factor is the maximum strain to which the blank may be subjected. Maximum strain is dependent upon the properties of the blank, in particular the gage or n-value. Considering these three factors and using the following equation will determine whether the blank can be 100% stretched:

$$0 \leqq \text{maximum strain } \% - [(\text{final length} - \text{original length})\ \text{original length}] \times 100.$$

If the equation is satisfied, the blank can be 100% stretch-formed. If it is not satisfied, the blank must be allowed to flow into the part print defined in the upper die 14.

The equation will now be applied to the part print of the present invention, and in particular with reference to FIG. 5. From the male bead 120 on the left side of the upper die 14 to point 116, the original length of the blank is approximately 62". The final length of the blank along that portion of the part print is approximately 65". Using a blank which has a maximum strain value preferably ranging from 2% to 7%, the equation is satisfied and thus the male bead 120 at the left side of FIG. 5 is shaped to bite into the blank 16 and prevent it from slipping during the hydroforming process. Turning to the right side of the apparatus as shown in FIG. 5, from point 116 to the male bead 120, the original length of the blank is much shorter than the final length of the part print defined by the deep cavity. It was found that the blank 16 could not be 100% stretched to the shape of the cavity, Thus the male bead 120 at the right side of the apparatus had to be shaped to allow the blank to flow past the male bead 120 and into the cavity of the desired part print.

With reference to FIG. 3, it was found that the desired part print could be formed by shaping the male bead 120 along sides 71, 73 and 75 of the periphery to bite into the blank and allowing the blank to flow from side 79.

Figure 8:
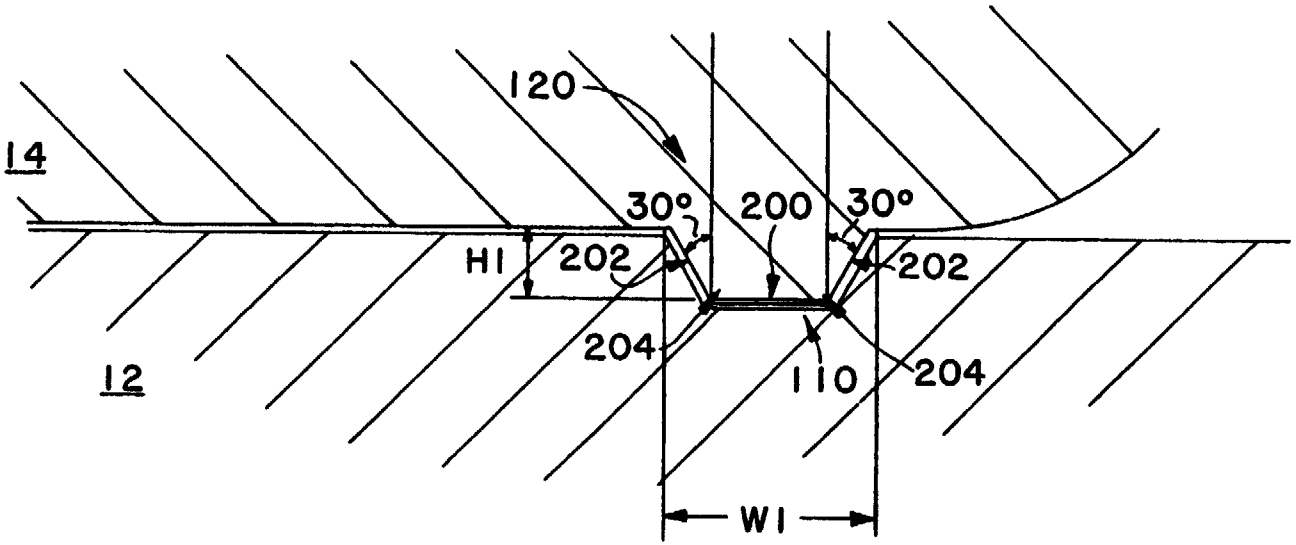
FIG. 8 is a blown-up view of the male and female bead shown in FIG. 7.

FIG. 8 illustrates the male bead 120 shaped to bite into the blank thereby preventing the sheet blank from slipping engaged with the female bead 110 as shown in FIG. 7. While it should be understood that the size and shape of the bead may vary somewhat depending upon such factors as the size of the die and the materials used to form the beads and the sheet metal blank, the following dimensional requirements are significant. The male bead 120 comprises a horizontal base section 200 and edges 202. The overall width of the bead W1 is preferably 1.0 inch. The height of the bead H1 is preferably 0.38". The edges are inclined with respect to vertical axis V preferably at 30°. As described previously, the male bead 120 has generally a rectangular cross-section. The control the bead 120 exercises is determined by the two corners 204. As shown in FIG. 8, the corners 204 are sharp formed by the planar edges 202 meeting the horizontal base 200.

The female bead 110 forms a cavity in the lower die 12. The shape of the female bead 110 is approximately the same as the male bead 120 already described. Unlike the male bead 120, however, the female bead 110 has the same shape along the entire length of its periphery. The female bead 110 has the same overall width W1 as the male bead 120. The corners of the bead 110 preferably have a radius of 0.25". When the upper die 14 is lowered upon the lower die 12 as shown in FIG. 8, corners 204 of the male bead 120 squeeze the blank between the base sections of the male and female beads and between the edge sections. Preferably the distance between the base 200 of the male bead 120 and the base of the female bead 110 when the upper die 14 is lowered onto the lower die 12 is the thickness of the blank minus 0.010".

Figure 9:
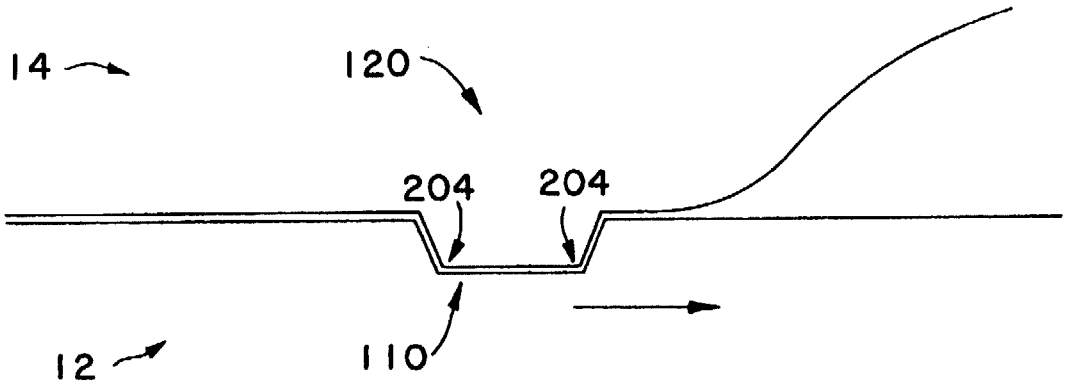
FIG. 9 is a cross-sectional view of the male bead having a different profile from that shown in FIGS. 7 and 8 engaged with the female bead.

FIG. 9 illustrates the male bead 120 shaped to allow the blank to flow across the bead 120 engaged with the female bead 110. The corners 204 of the bead 120 are rounded compared to the corners of the bead shown in FIGS. 7 and 8. Preferably, the corners 204 have a radius of 0.62". When the upper die 14 is lowered upon the lower die 12, the blank will not be pinched between the male and female bead, instead the blank is able to flow into the desired part print defined in upper die 14 in the direction of the arrow into the mold cavity.

According to the presently preferred embodiment, the apparatus 10 designed to perform controlled material flow hydroforming. In particular, the part print defined by the upper die 14 is a complex style automobile deck lid to be formed from a 0.030 inch thick sheet metal blank 16. The male bead 120 is part of the upper die 14 and has a hardness of RC 58–60. The female bead 110 is part of the lower die 12 and has a hardness of RC 58–60. With reference to FIG. 3, the male bead 120 along the three sides 71, 73 and 75 of the periphery 74 is shaped to bite into the blank as shown in FIG. 8. Along the fourth side 79 of the periphery 74, the corners 204 of the bead 120 are rounded to allow the blank to flow past the bead 120 along that edge. Along a substantial portion of the fourth side, the bead 120 is shaped according to FIG. 9. In a transition area comprising 5" from the ends of side 79, towards the center of side 79, the radius of curvature of the bead 120 increases from that shown in FIG. 8 to that shown in FIG. 9. The result of varying the corners of the male bead 120 along the periphery 74 of the part print creates a hydrid of stretch and draw forming. While a particularly shaped male and female bead have been illustrated, the present invention is not limited to the beads shown. The beads described in U.S. Pat. No. 4,576,030 incorporated herein by reference can be used according to the present invention where the profile of the beads are altered to exercise the necessary control on the blank. In addition, other means that allow the blank material to flow in some areas while gripping the blank in other areas may be used with the present invention.

The operation of apparatus 10 may be described as follows:

The basic die is the holder and input transformer of the present invention while the specific tooling comprising the upper and lower dies comprises the interchangeable attachments to form the desired part.

In the open position, inner slide 13 is in the up position. Also, outer slide 11, riser 18 and upper die 14 are all in the up position, several feet above and away from the lower die 12. A rectangular, sheet metal blank 16 is positioned on top of lower die 12. The blank 16 is loaded from the left of apparatus 10 shown in FIG. 1. The locators 76 and lifters 77 are all in their raised positions. The locators 76 guide the blank 16 so that it is properly positioned on the lower die 12 by guiding the blank 16 with the edge of the locator 76 and positioning the lifters 77 underneath the blank 16. The blank 16 when finally positioned, rests on the flat surfaces of the lower die 12.

With the blank properly loaded, the outer slide 11 is lowered which brings the upper die 14 towards the blank 16 and the lower die 12. Point 116 of the upper die 14 first contacts the blank 16 forcing it to wrap around the point. As the outer slide 11 continues its descent, the blank 16 generally has a shape much like the cross-section of the surfaces of the dies 12 and 14 shown in FIG. 1. When the die 14 is fully lowered the male bead 120 is pressed against the blank 16 and both are forced into the cavity formed by the female bead 110. The male bead 120 along the three sides 71, 73 and 75 of the periphery 74 bite into the blank 16, while the male bead 120 along the fourth side 79 of the periphery 74 (right hand side of die as shown in FIGS. 1 and 5) allows the blank 16 to flow into the cavity of the desired part print.

Inner slide 13 then is lowered and forces the blocks 44 and 45, collar 43 and piston rods 42 of the cylinder assemblies down, thereby forcing hydraulic fluid from the cylinders through the valving in lower heads 38 to passageways 44, 47 and 49, and into the region between the blank and the upper surface 48 of the lower die 12. The fluid used in the present embodiment is 95% water. The remaining 5% consists of additives to prevent ruse and corrosion and to aid in lubrication. This fluid is commercially available under the name Hydrolubric 123 from E.F. Houghton and Company. The fluid supplied to the upper surface 48 of the lower die 12 is of sufficient pressure to force the blank 16 against the surface of the upper die 14 thereby conforming to the desired pare print. Along the three sides 71, 73 and 75 of the periphery 74 where the blank 16 is firmly gripped by bead 120, the blank 16 will be stretched against the desired part print. Along the fourth side 79 the bead 120 allows the blank 16 to flow into the deep cavity formed in the desired part print.

The hydraulic pressure required to completely form blank 16 into part print cavity defined in the upper die 14 depends upon the properties and thickness of blank 16 and the configuration of various portions of the part print. The required hydraulic pressure will therefore vary each time the specific tooling is changed or the parameters of blank 16 are changed. Pressure relief valves attached to the lower heads 38 of the cylinder assemblies are therefore adjusted as necessary for each different forming operation. In addition, the shape of the male bead surrounding the desired part print will be different for each specific tooling.

After completion of the hydroforming operation, the inner slide 13 moves up and gas springs 34 and 36 of the cylinder units push the collar 43 upward, thereby lifting piston rods 42 and blocks 44 and 45 upward to reset the hydraulic cylinder units. Fluid released or escaping from between upper and lower dies 12 and 14 falls into fluid reservoir pan formed by the base and walls of the tub 22 and is drawn as needed into lower heads 38 through appropriate valved ports (not shown). Apparatus 10 is thus provided with automatically recirculating hydraulics.

While inner slide 13 is raised, outer slide 11 is also raised, lifting the upper die 14 away from the formed blank and lower die 12. The lifters 77 pop up thereby lifting the metal from the flat surfaces of the lower die 12. The formed blank may then be removed from the apparatus 10 either manually or with a mechanical device.

When it is desired to form a different part with apparatus 10, instead of replacing the entire complement of die components within the press frame as in prior art devices, huge, multi-part components often weighing more than 100,000 pounds, all that needs to be replaced in the present invention is the specific tooling, die halves 12 and 14. The two dies 12 and 14 of the present invention are comparatively smaller and weigh together about 10,000 pounds. This represents a significant economic and logistic improvement over the prior art.

A locking mechanism is preferably retrofitted to a conventional double action press and in particular to apparatus 10 shown in FIG. 1. While the locking mechanism is shown retrofitted to a controlled hydroforming press of the present invention, it may also be used in conjunction with other presses such as the press disclosed in U.S. Pat. No. 4,576,030 or the press disclosed in U.S. Ser. No. 07/855,815 described above. The locking mechanism will now be described with reference to FIGS. 5 and 11. The locking mechanism is generally indicated as 100. As shown in FIG. 5, two identical locking mechanisms are located on each side of apparatus 10. The locking mechanism includes three major elements. First a driver 210 is mounted to the inner slide 13 in such a manner that the driver 210 moves with the inner slide 13. Secured to each side of the riser 18 is a driver guide 212. The driver guide 212 is secured by conventional means to the riser 18 as will be appreciated by those skilled in the art. The driver guide 212 has a passageway defined therein through which the driver 210 extends when the inner slide 13 is lowered as shown in FIG. 5. The driver guide 212 is located between the brackets 19 (FIG. 11) which link the upper die 12 to the riser 18 as previously described. A locking arm 216 is mounted on the manifold 20 by a block with a pivot joint 118 (Shown in FIG. 11). A rest block 220 having an inclined surface is connected to the base 28 of the tub 22 directly underneath the locking arm 216.

The end of the driver 210 has an angled surface 122 facing the locking arm 216. Preferably surface 122 forms an angle 31° with reference to the vertical. At the top of the locking arm 216 is an angled surface 124 which faces the driver 210. Preferably surface 124 forms an angle of 36° with reference to the vertical and a large radius at the top and bottom of the angled surface. At the top of the locking arm 216 opposite to the angled surface 124 is a lip 130. When the arm 216 is in its locked position, the lip 130 of the arm 216 is over the top of the upper die 14 thereby preventing it from moving in an upwards direction as shown in FIG. 5. When the arm 216 is in its unlocked position, shown in phantom in FIG. 5, the lip 130 is disengaged from the top of the die 14. Preferably the lip 130 rides over a block 131 mounted to the top of the upper die 14. The lip 130 and the block 131 preferably have an angled surface of 5° with reference to the horizontal.

When the inner slide 13 is in its raised position, the surface 122 of the driver 210 is above the locking arm 216 and does not make any contact with the arm 216. The base 160 of the arm 216 rests on the rest block 220 and thus the arm is tilted away from the upper die 12 by 3.75° from the vertical as shown in phantom. When the inner slide 13 is lowered, the angled surface 122 of the driver 210 makes contact with the angled surface 124 of the arm. As these surfaces contact one another, the arm will be pushed towards the die 14 by the driver 210. Finally when the arm 216 is in its upright locked position, the driver 210 slides along the back of the arm as shown in FIG. 11.

As shown in FIG. 11 the locking arm 216 spans between the retainer brackets 19 and thus covers a substantial portion of the side of the upper and lower dies when the arm 216 is in its locked position. During the forming process the upper die 14 is exposed to high pressures from the liquid delivered by the cylinder assemblies. The possibility of the upper die 14 deflecting increases as the fluid pressure exerted on the die 14 increases. The arm 216 supports the dies 12 and 14 on their sides and thus helps to keep the dies in vertical alignment during the forming process.

FIG. 11 illustrates the locking arm 216 in its locked position viewed from the right side of the apparatus shown in FIG. 5. The driver 210 is shown in its lowest position. The riser 18 is pressed against the upper die 14 so that the retainer pins 21 in the brackets 19 are at their top position. Also illustrated in FIG. 11 are the positive returns 25 located on the sides of the retainer brackets 19 facing the locking arm 216 and the positive returns 27 located on both sides of the locking arm 216. The positive returns 25 may alternatively be located on said upper die 14.

Figure 12:
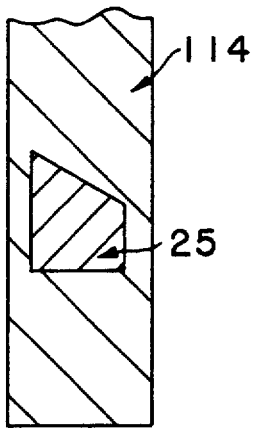
FIG. 12 illustrates the positive return mounted on the locking arm shown in FIG. 11.
Figure 13:
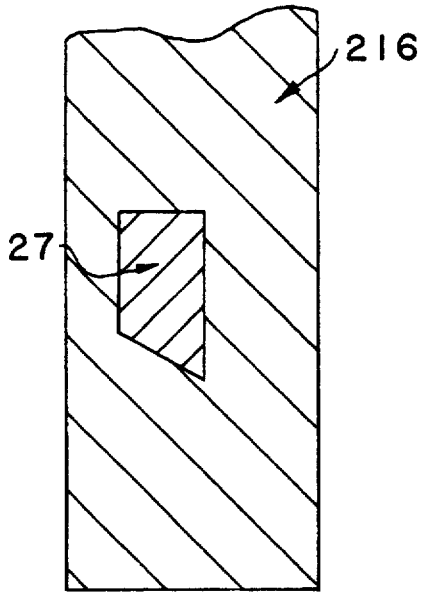
FIG. 13 illustrates the positive return mounted on the retainer bracket linking the upper die to the riser shown in FIG. 11.

FIG. 12 illustrates a positive return 25 located on a bracket 19. The positive return 25 comprises a steel block having an inclined surface. The inclined surface preferably forms an angle of 36° with respect to the vertical. FIG. 13 illustrates a positive return 27 located on one side of the locking arm 216. Like the positive return located on the brackets, the positive return comprises a steel block having an inclined surface. The inclined surface on return 27 is complementary to the inclined surface on the arm. Referring to FIGS. 5 and 11, after the forming process is complete, the locking arm 216 must be tilted back to its unlocked position so that the upper die 14 can be raised. Sometimes when the fluid pressure is removed, the upper die 14 may be raised slightly making it difficult for the locking arm 216 to tilt back to unlocked position. The positive returns ensure that the locking arm 216 will return to its unlocked position.

When the forming process is completed, the inner slide 13 is raised thereby raising the riser 18 and the brackets 19. As the brackets 19 are raised; the inclined surface of the positive return 25 on the bracket 19 engages the inclined surface of the positive return 27 on the locking arm 216 thereby forcing the arm to tilt back to its unlocked position.

The locking mechanism can thus be easily retrofitted to a conventional double action press thereby adapting the press for performing under the high pressures used in the hydroforming process.

While the present embodiment is intended to receive a single piece of sheet metal at a time, the invention also contemplates forming sheet metal in a coil fed arrangement (a progressive die). Such an apparatus would provide a cutting device at the back or exit side which would cut off the formed part on the down stroke.

While the invention has been shown and described in connection with a particular preferred embodiment, it is apparent that certain changes and modifications, in addition to those mentioned above, may be made by those who are skilled in the art without departing from the basic features of the present invention. Accordingly, it is the intention of the Applicants to protect all variations and modification within the true spirit and valid scope of the invention.

What is claimed is:

1. An apparatus for forming sheet metal using a liquid to directly form the metal comprising:

a die having a part print for a part to be formed;

a holder for holding the sheet metal across the die where a space is created between one surface of the metal and the pan print formed in the die, said holder including beads having different radiuses of curvatures for providing a desired amount of controlled flow of said sheet metal into the space while maintaining a fluid tight seal;

hydraulic cylinders for applying liquid directly against the sheet metal at a pressure great enough to force the metal to travel through the space and contact the part print defined in the die; and means to actuate said hydraulic cylinders:

wherein said holder exercises control on the metal to allow portions of the metal to stretch across the part print while other portions of the metal are allowed to flow into the pan print.

2. A method for forming sheet metal using a liquid to directly form the metal comprising the steps:

holding a sheet of metal across a die having a part print defined therein wherein a space is created between one surface of the metal and the pan print;

applying liquid directly against the sheet at a pressure great enough to force the sheet to travel through the space and contact the pan print defined in the die;

controlling the movement of the sheet when the liquid is applied wherein portions of the sheet are stretched across the part print while other portions are allowed to flow into the pan print by providing beads having different radiuses of curvatures which control the amount of metal flow.

3. An apparatus for forming sheet metal using a liquid to directly form said metal comprising:

a die shaped for the pan to be produced;

a plurality of beads for gripping the sheet of metal to define a closed periphery and said die extending across said periphery so that an enclosed space is created between said die and said sheet metal;

means for applying the liquid directly against the sheet metal at a hydraulic pressure great enough to bring the sheet metal into said space and into contact with said die to conform the sheet metal to said die; and said plurality of beads having varying profiles about said closed periphery ranging from a first profile which prevents the sheet metal from moving past the beads to a second profile which allows the sheet metal to flow past the beads wherein said beads accommodates the shape of the die and the properties of the sheet metal.

4. The apparatus of claim 3 wherein said means for applying liquid comprises:

a cylinder assembly for pressurizing it liquid to form a pressurized liquid;

an enclosure defining a liquid chamber on the side of the sheet metal opposite of the enclosed space; and a first passageway for transmitting said pressurized liquid into said liquid chamber.

5. A method for forming sheet metal against a shaped die using liquid directly applied to said sheet metal to produce a shaped pan, said method comprising the following steps:

locating said sheet metal across said shaped die by a plurality of stretch beads and a plurality of draw beads defining a closed periphery wherein said die extends across said periphery so as to create a space between the sheet metal and the shaped die;

applying the liquid against said sheet metal at a hydraulic pressure sufficiently great to force the sheet metal into said space and against said shaped die to produce the shaped part, portions of the periphery are defined by said draw beads having a profile which allows the sheet metal to flow if necessitated by the shape of the die and properties of the sheet metal and other portions of the periphery defined by said stretch beads having a profile which prevents the sheet metal from moving.

* * * * *